US006237249B1

(12) United States Patent
Aguerre

(10) Patent No.: US 6,237,249 B1
(45) **Date of Patent: *May 29, 2001**

(54) CONVERTIBLE SLIDE AND METHOD

(75) Inventor: Santiago J. Aguerre, La Jolla, CA (US)

(73) Assignee: South Cone, Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/298,276

(22) Filed: Apr. 22, 1999

(51) Int. Cl.[7] ..... A43B 3/12
(52) U.S. Cl. ..... 36/11.5; 36/30 R; 36/50 R
(58) Field of Search ..... 36/11.5, 100, 101, 36/59 R, 59 A, 28, 30 R, 31

(56) References Cited

U.S. PATENT DOCUMENTS

| | | | | |
|---|---|---|---|---|
| D. 102,345 | * | 12/1936 | Stein | 36/11.5 |
| 3,336,683 | * | 8/1967 | Schellkopf | 36/11.5 |
| 4,124,946 | * | 11/1978 | Tomlin | 36/11.5 |
| 4,897,936 | * | 2/1990 | Fuerst | 36/30 A |
| 4,899,467 | * | 2/1990 | Mackey | 36/59 A |
| 5,651,195 | * | 7/1997 | Clancy | 36/11.5 |
| 5,687,492 | * | 11/1997 | Muraoka | 36/11.5 |
| 5,901,467 | * | 5/1999 | Peterson et al. | 36/29 |

FOREIGN PATENT DOCUMENTS

| | | | | |
|---|---|---|---|---|
| 1183183 | * | 7/1959 | (FR) | 36/11.5 |
| 359913 | * | 4/1930 | (GB) | 36/11.5 |

* cited by examiner

*Primary Examiner*—Paul T. Sewell
*Assistant Examiner*—Jila M. Mohandesi
(74) *Attorney, Agent, or Firm*—Lewis, D'Amato, Brisbois & Bisgaard, LLP

(57) ABSTRACT

A convertible slide and method for slide-type sandals typically used in the out-of-doors includes rubber and synthetic materials and exhibits a lightweight robust, high-strength, flexible construction including a midsole for supporting a foot. A vamp is securely attached to the midsole for covering the foot and includes a pair of outwardly extending studs for providing a pair of pivot points. A rear heel strap is provided for securing the convertible slide to the foot. The heel strap is rotatively connected to the pair of outwardly extending studs for rotating between a first lowered position about the heel of the foot and a second raised position above the vamp. Finally, an outsole is bonded to the midsole for contacting the ground surface. In a first alternative embodiment, the pair of outwardly extending studs is replaced by a pair of rivets while in a second alternative embodiment, the pair of outwardly extending studs is replaced by a pair of threaded screws.

22 Claims, 6 Drawing Sheets

CONVERTIBLE SLIDE AND METHOD

BACKGROUND OF THE INVENTION

1. Field of the Invention

The present invention relates to footwear. More specifically, the present invention relates to methods and apparatus for a slide-type sandal having a rear heel strap that is rotatable about pivot points to facilitate use of the sandal with or without the rear heel strap and without disassembling the sandal.

2. Description of the Prior Art

The prior art is directed to methods and apparatus for the construction of sandal type footwear. Sandals are one of the first types of footwear known to mankind and are mentioned in early recorded history. Early sandals included a flat component formed of a suitable material such as leather that served as a sole. The flat sole was placed under the foot to provide protection against the ground surface.

Various methods to attach the sandal to the foot are also known. An example includes the use of a suitable material such as leather to attach the sole of the sandal to the toes or ankle of the foot. In more recent times, a component of the sandal identified as a vamp and which covers the instep of the foot has been employed. The vamp is connected to the sole so that the sandal can be attached to the foot. The vamp may only partially cover the top of the foot so that the toes extend outward into the open air. In the alternative, the vamp may cover most of the top of the foot or even enclose the entire forward portion of the foot.

In the type of sandal that includes a vamp, the foot is positioned between the sole and the vamp. The sandal may be utilized in this manner without employing any additional means of attaching the sandal to the foot. This type of footwear is sometimes referred to as a "slide" because the foot enters the sandal by sliding since there is no structure to grab onto while donning the sandal. Further, this type of footwear has also been referred to as "flip-flops" because of the noise created by the tail end of the sole striking the heel of the user when walking. Under these conditions, the sandal is only loosely attached to the foot and is useful for more leisurely types of activities. More active types of activities requiring quicker movements could result in the sandal becoming inadvertently disconnected from the foot which might be undesirable.

Sandals that include a vamp can also employ additional means for attaching the sandal to the foot. For example, a suitable material such as leather can be used in strips to tie the sole and/or the vamp of the sandal to the foot. However, it has been known to employ a rear heel strap that is connected to the sandal. The rear heel strap can be connected to the vamp or other structural component of the sandal. The rear heel strap is used to wrap around the heel of the foot to ensure that the sandal remains attached to the foot.

Some sandals known in the prior art employ a rear heel strap that can be disconnected from the sandal. To achieve this disconnect feature, the sandal can incorporate buckles, hook and eye fasteners and other types of mechanical fasteners to connect and disconnect at least one end of the rear heel strap to and from the sandal. Typically, this type of sandal would only be used with the rear heel strap since only one end of the rear heel strap could be disconnected. If both ends of the rear heel strap could be disconnected, the sandal could be used as a "slide" or "flip-flop". However, this would require the time and energy to physically remove the rear heel strap. Once removed, it would be necessary to store or carry the rear heel strap to prevent loss thereof. Since sandals are often used at the beach and at swimming pools, storage of the rear heel strap in order to avoid loss could be inconvenient. This is the case since beachwear normally worn at the seashore and around swimming pools often does not include pockets.

Thus, there is a need in the art for a sandal that includes a vamp attached to the sole and having an elastic rear heel strap that is rotatable about a pair of pivot points so that the rear heel strap can be pivoted between a lowered position about the heel of the foot and a rotated raised position over the arch of the foot and vice versa by employing simple foot manipulation to rotate the strap so that the sandal can be utilized with or without the elastic rear heel strap without disassembling the sandal.

SUMMARY OF THE INVENTION

Briefly, and in general terms, the present invention provides a new and improved convertible slide type sandal typically worn as footwear in the out-of-doors during the warm months of the year. However, the convertible slide can be used indoors as well as at the beach or the swimming pool. The novel and non-obvious convertible slide exhibits a cushioned midsole upon which a human foot rests. The midsole is attached to a durable outsole which contacts the ground surface. Bonded to the midsole and arching over the top of the foot is a vamp. The vamp covers only a portion of the human forefoot resulting in an open-toed footwear. Pivotably attached to the vamp is a rear heel strap used to assist in securing the convertible slide to the human foot. The components of the convertible slide are comprised of rubber and manmade synthetic cushioning materials. Further, the convertible slide exhibits a lightweight robust, high-strength, flexible construction and is economical to manufacture.

The rear heel strap of the inventive convertible slide is elastic or other flexible material to facilitate attaching the sandal to the foot. The elastic rear heel strap can be connected to the vamp by one of several different methods. In a preferred embodiment, the vamp includes a pair of outwardly extending studs comprised of, for example, polyvinylchloride (PVC) and molded directly to the side of the vamp. The pair of outwardly extending studs serve as pivot points for a pair of terminal ends of the rear heel strap. The terminal ends of the rear heel strap each include a penetration for passing over a corresponding one of the pair of outwardly extending studs. Each of the outwardly extending studs includes a mechanical stop for retaining the rear heel strap on each of the outwardly extending studs. The construction of the present invention enables the rear heel strap to be rotated between a first lowered position about the heel of the foot to a second raised position above the vamp without disassembling the sandal. The top rear surface of the vamp includes a contoured lip that retains the rear heel strap in the second raised position.

The present invention is generally directed to a convertible slide type sandal typically used in the out-of-doors and comprised of rubber and synthetic materials for exhibiting a lightweight robust, high-strength, flexible construction. In its most fundamental embodiment, the convertible slide comprises a construction having a midsole for supporting a foot. A vamp is securely attached to the midsole for covering the foot and includes a pair of outwardly extending studs for providing a pair of pivot points. A rear heel strap is provided for securing the convertible slide to the foot. The heel strap is rotatively connected to the pair of outwardly extending studs for rotating between a first lowered position about the heel of the foot and a second raised position above the vamp. Finally, an outsole is bonded to the midsole for contacting the ground surface. Also, the midsole can be comprised of ethylene vinyl acetate, the outsole can be comprised of rubber and both the vamp and the rear heel strap can be comprised of polyvinylchloride.

In a first alternative embodiment, the pair of outwardly extending studs are replaced by a pair of rivets that are used to attach the rear heel strap to the midsole and vamp. The pair of rivets are installed through appropriately placed penetrations formed in the midsole and vamp. A pair of nylon washers are utilized to separate the elastic rear heel strap from other components and to facilitate the rotation thereof. In a second alternative embodiment, the pair of outwardly extending studs and the pair of rivets are replaced by a pair of threaded screws. The pair of threaded screws are also installed through appropriately placed penetrations formed in the midsole and vamp. Each of the threaded screws cooperate with a correspondingly threaded T-nut that is installed in a recess on the inside surface of the midsole. In this second embodiment, the threaded screw and thus the rear heel strap is removable.

These and other objects and advantages of the present invention will become apparent from the following more detailed description, taken in conjunction with the accompanying drawings which illustrate the invention, by way of example.

DESCRIPTION OF THE INVENTION

Figure 1:
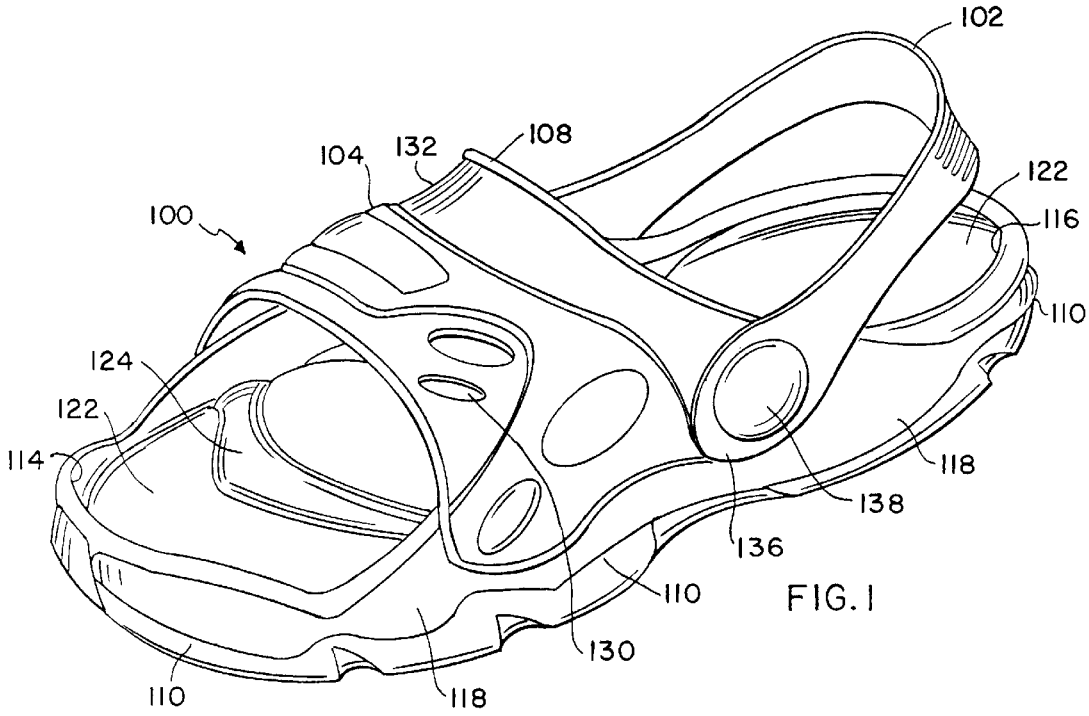
FIG. 1 is a front perspective view of a convertible slide of the present invention showing a rear heel strap in a lowered position so as to be fitted about the back of the heel of a human foot.

The present invention is a convertible slide 100, i.e., a slide-type sandal, having an elastic and flexible rear heel strap 102 which is pivotably attached to a vamp 104 and where, in a preferred embodiment, the rear heel strap 102 is rotatable about a pair of outwardly extending studs 106 which serve as pivot points to facilitate use of the convertible slide 100 with or without the rear heel strap 102, all without disassembling the sandal. In the lowered position, the rear heel strap 102 fits snugly behind the heel to secure the convertible slide 100 to the human foot. However, in the rotated raised position, the rear heel strap 102 is securely retained in the raised position by a contoured lip 108 molded to the top rear side of the vamp 104. The bottom of the foot is supported by a cushioned midsole 110 positioned above and sealed to a rugged outsole 112 to provide a lightweight robust construction.

Figure 2:
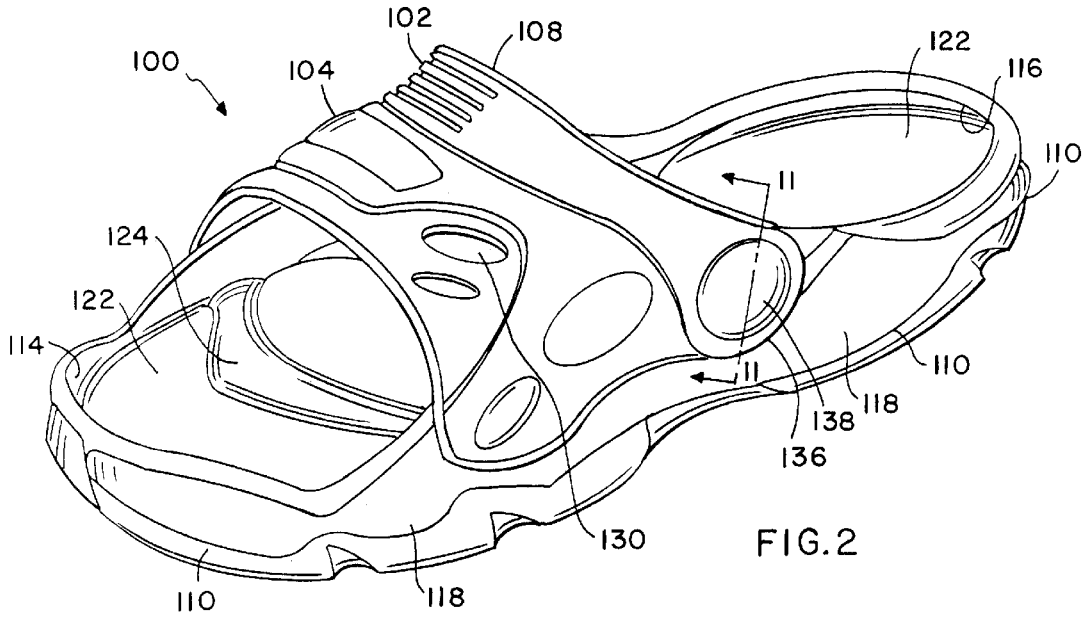
FIG. 2 is another front perspective view of the convertible slide of FIG. 1 showing the rear heel strap in a rotated raised position and resting forward of a contoured lip on the rear side of a vamp.

The preferred embodiment of the convertible slide 100 is best shown in FIGS. 1–4. The cushioned midsole 110 of the convertible slide 100 is a main component of the present invention since each of the other components are attached thereto. The midsole 110 as shown in FIGS. 1 and 2 is a molded component and can be comprised of ethylene vinyl acetate known in the art as "EVA". Portions on the bottom of the midsole 110 contact the floor or ground surface while the top of the midsole 110 supports a human foot. The midsole 110 includes a forward section that curls upward in the forefoot area and is known as a toe bumper 114 as shown best in FIGS. 1 and 2 but also in FIGS. 3–4, 7 and 15. Likewise, the midsole 110 includes a rearward section that curls upward in the heel area and is known as a heel bumper 116 also shown in FIGS. 1–4, 7 and 15. Both the toe bumper 114 and the heel bumper 116 are an integral molded part of the midsole 110. The full length of the midsole 110 is clearly shown in FIGS. 7 and 15.

Figure 8:
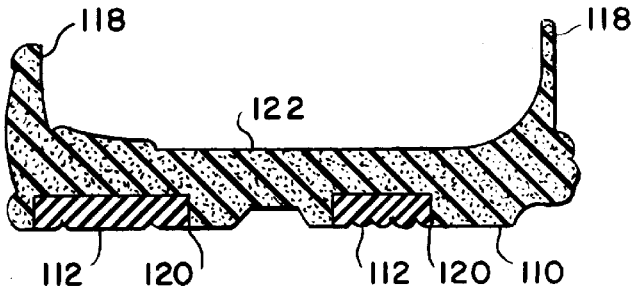
FIG. 8 is a first transverse cross-sectional view of the convertible slide of FIG. 1 taken along line 8—8 of FIG. 6 and showing the outsole secured to the bottom of the midsole.
Figure 9:
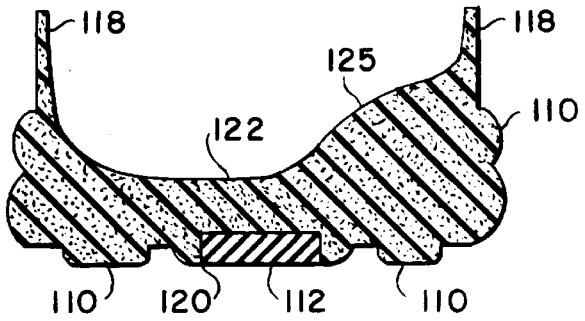
FIG. 9 is a second transverse cross-sectional view of the convertible slide of FIG. 1 taken along line 9—9 of FIG. 6 and showing the instep arch support and the outsole secured to the bottom of the midsole.
Figure 10:
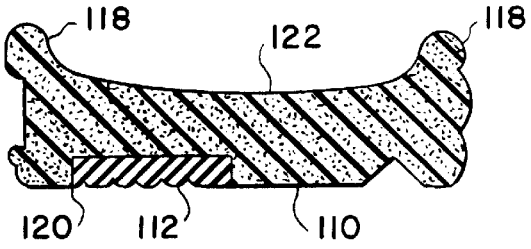
FIG. 10 is a third transverse cross-sectional view of the convertible slide of FIG. 1 taken along line 10—10 of FIG. 6 and showing the outsole secured to the bottom of the midsole.

The midsole 110 not only includes the forefoot toe bumper 114 and the rearward heel bumper 116 that wrap about the foot, it also includes a continuous side portion 118 about the convertible slide 100 as shown in FIGS. 1–4. The side portion 118 rises up along the side of the foot as part of the midsole 110 as is also clearly shown in FIGS. 8–11. FIGS. 8–10 each illustrate cross-sectional views taken at different locations along the long dimension of the convertible slide 100, i.e., across the forefoot, arch and heel sections of the sandal, respectively. As can be seen from FIGS. 8–10, the height and width of the side portion 118 varies along the length dimension of the convertible slide 100. Thus, the dimension of the side portion 118 as shown in FIGS. 1–4 can be seen to vary at different locations around the circumference of the sandal by referring to FIGS. 8–10.

In addition to the toe bumper 114, the heel bumper 116 and the side portion 118, the mold of the midsole 110 wraps underneath to form the bottom of the convertible slide 100 to support the bottom of the foot. Reference should be made to FIGS. 6–10 which show the bottom portion of the molded midsole 110 that interfaces with the rugged outsole 112 of the convertible slide 100. In particular, FIGS. 7–10 clearly show the molded midsole 110 extending from the side portion 118 downward on both sides and integral with that portion of the midsole 110 that forms the bottom of the sandal. As is clearly shown, a plurality of recesses 120 are formed in the bottom of the midsole 110 for receiving pieces or sections of rubber or synthetic material which form the rugged outsole 112. The rubber pieces that form the outsole 112 are shown located within the recesses 120. Further, the sections of rubber that form the outsole 112 are positioned at the same level as the immediately adjacent portions of the midsole 110 as shown in FIGS. 7–10. Thus, the surface of the outsole 112 and consequently the bottom surface of the convertible slide 100 remains flat which is necessary in order to avoid unbalancing the sandal and interfering with the walking pattern of the person wearing the sandal.

Figure 6:
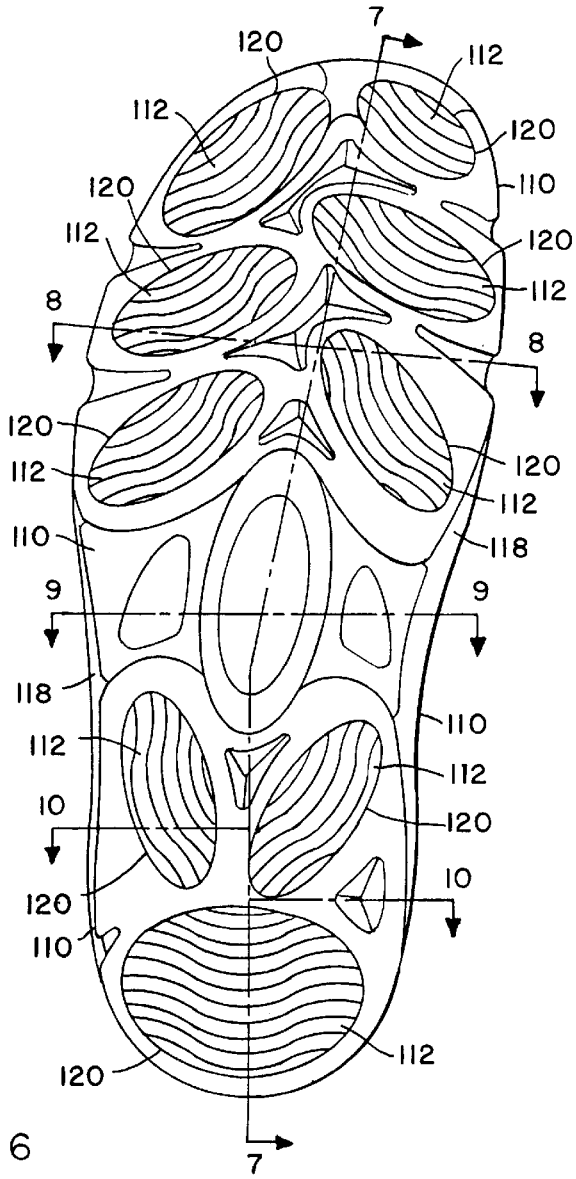
FIG. 6 is a bottom planar view of the convertible slide of FIG. 1 showing the outsole secured to the bottom of the midsole.

The interface between the bottom portion of the midsole 110 and the outsole 112 is clearly shown in FIG. 6. As can be seen, a pattern of oval shaped pieces or sections of rubber or other rugged synthetic material are affixed within the recesses 120 formed in the bottom of the outsole 110. By forming the outsole 112 in separated discrete pieces as shown in FIG. 6, the overall weight of the convertible slide 100 is reduced resulting in a lighter weight sandal. Lightweight sandals are typically more desirable since they represent a reduced load that must be carried by the foot. Notwithstanding the reduced weight load, the construction of the convertible slide 100 of the present invention is rugged and robust.

The discrete pieces of rubber that form the outsole 112 are bonded to the underlying midsole 110 within the recesses 120 with a suitable adhesive known in the footwear manufacturing art. The individual pieces of rubber that form the outsole 112 include a plurality of suitable treads as shown in FIG. 6. The treads of the individual pieces of rubber that form the outsole 112 are oriented so as to generate traction on the floor or ground surface when walking. It is clear from FIGS. 7–10 that the outsole 112 makes contact with the floor or ground surface. However, it is equally clear that the midsole 110 which is positioned at the same level as the outsole 112 also makes contact with the floor or ground surface at selected points on the bottom of the convertible slide 100.

Figure 5:
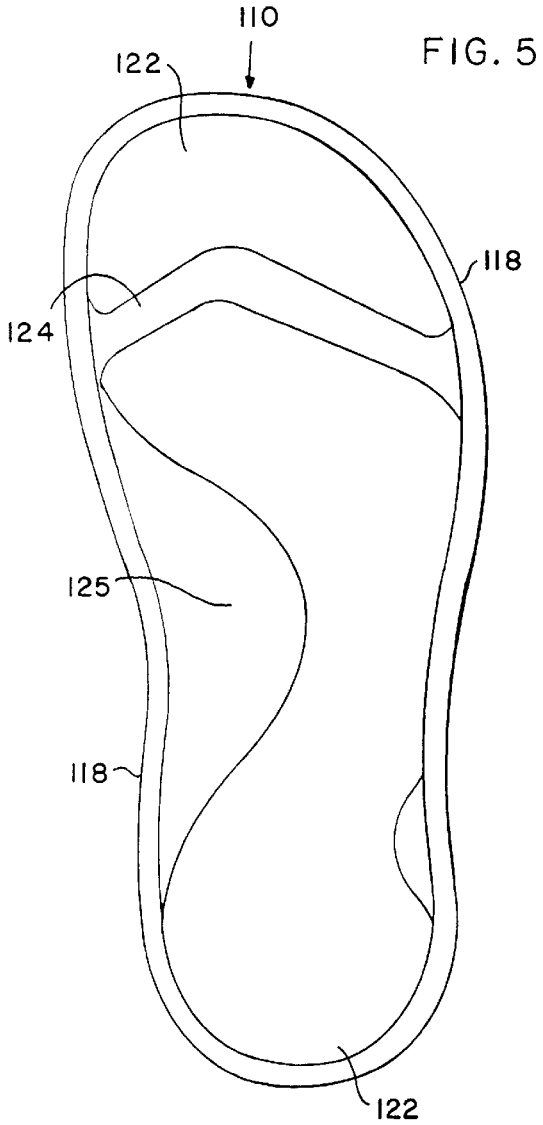
FIG. 5 is a top planar view of the convertible slide of FIG. 1 with the vamp removed and showing a foot bed including a toe bar and an instep arch support upon which the human foot rests.

The surface upon which the human foot rests within the convertible slide 100 is referred to as the "foot bed". In the preferred embodiment of the present invention, the "foot bed" is the top surface 122 of the midsole 110 as shown in FIGS. 1, 2, and 7–10 but is best shown in FIG. 5. The midsole 110 is cushioned and typically is comprised of ethylene vinyl acetate (i.e., "EVA"). The top surface 122 of the midsole 110 can be contoured to fit the shape of the human foot to improve comfort as is shown in the planar view of FIG. 5. The circumference of the midsole 110 shown in FIG. 5 is intended to indicate the side portion 118. Positioned in a transverse manner in the forefoot portion of the convertible slide 100 is a toe bar 124. The toe bar 124 is molded to the top surface 122 of the midsole 110 and is utilized by the toes of the foot to grip the top surface 122 for stabilizing the convertible slide 100, i.e., to improve the grip of the toes on the sandal. Also molded to the top surface 122 of the midsole 110 is an instep arch support 125 as is clearly shown in FIG. 5. The instep arch support 125 is a subtle rise molded into the top surface 122 that supports the arch portion of the foot. In addition to the toe bar 124 and the instep arch support 125, the foot is bounded by the toe bumper 114 and the heel bumper 116 when the foot rests on the top surface 122 of the midsole 110.

If additional cushioning and air circulation is desired when wearing the convertible slide 100, a fabric can be attached to the top surface 122 of the midsole 110 by a suitable adhesive well known in the art. The fabric can include a combination of materials ranging from synthetic-to-leather materials. In the preferred embodiment, a suitable fabric could include a foam material 126 adhered to a fabric backing incorporated within a mesh material 128. This combination of materials employed to form the fabric is shown mounted upon the top surface 122 of the midsole 110 in FIG. 15. The addition of the foam material 126 and the mesh material 128 is the only feature that distinguishes FIG. 15 from FIG. 7. The surface upon which the human foot rests in FIG. 15, i.e., the "foot bed", is now the fabric comprised of the foam material 126 and the mesh material 128. The foam material 126 improves the cushioning previously provided by the midsole 110. Additionally, the mesh material 128 functions to improve the circulation of air underneath the foot to reduce perspiration and related problems. It is noted that these fabric materials are only exemplary and alternative materials suitable for use in improving cushioning and ventilation can also be utilized.

Figure 7:
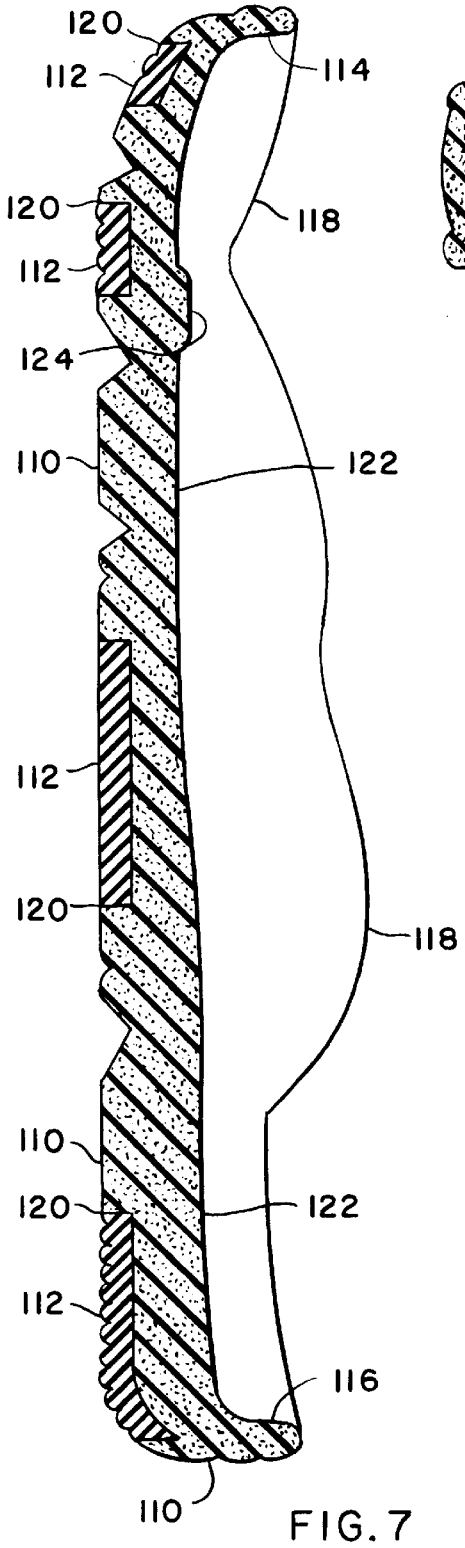
FIG. 7 is a longitudinal cross-sectional view of the convertible slide of FIG. 1 taken along line 7—7 of FIG. 6 and showing the outsole secured to the bottom of the midsole.
Figure 15:
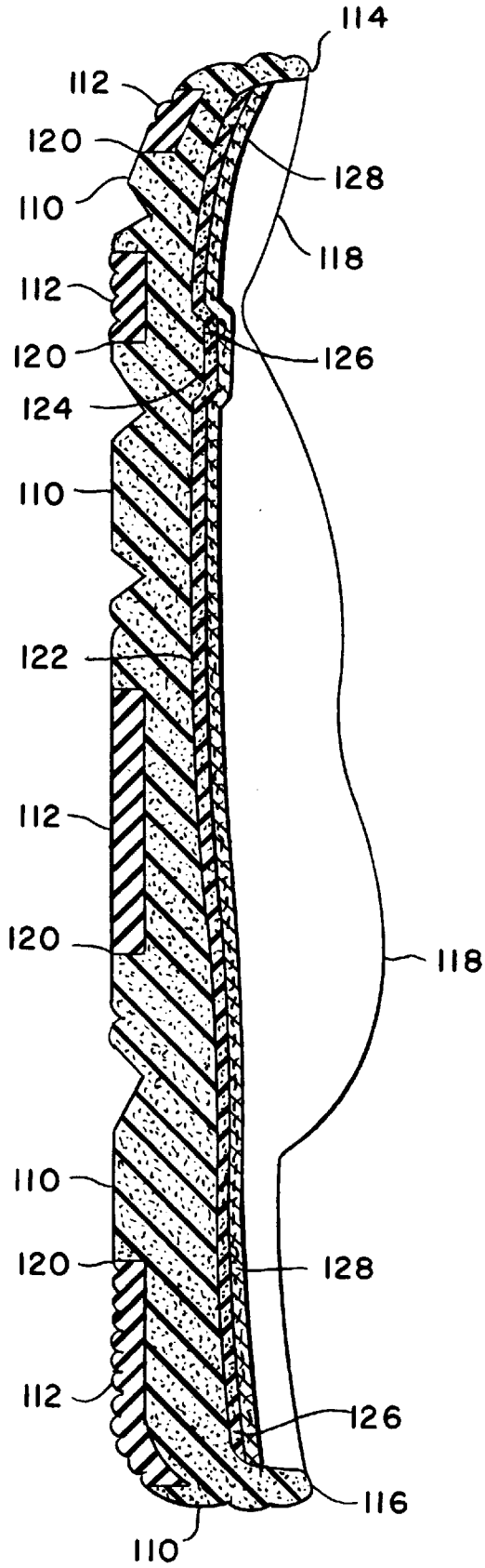
FIG. 15 is the longitudinal cross-sectional view of FIG. 7 showing a cushioned mesh fabric layer or other synthetic or leather layer mounted to the top of the midsole.

The vamp 104 is clearly shown arching over and attached to the midsole 110 in FIGS. 1–4. The vamp 104 is defined as that part of the convertible de 100 that covers the instep of the foot where the instep is the arched portion of the foot that rests upon the instep arch support 125 shown in FIG. 5. The vamp 104 is preferably comprised of polyvinylchloride (PVC) but can also be formed from rubber, silicon or a PVC-rubber combination. The vamp 104 is clearly shown in FIG. 1 and is bonded to the midsole 110. Reference to FIGS. 8–10 clearly show the side portions 118 of the midsole 110. The side portions 118 extend upward around the forefoot, the arch and the heel portion of the midsole 110 as shown consecutively in FIGS. 8, 9 and 10, respectively. It is noted that the side portions 118 are diminished in size along the long dimension of the convertible slide 100 from front to rear in FIGS. 8, 9 and 10, respectively. Further, FIGS. 7 and 15 show the long dimension of the upward extending side portions 118.

Figure 11:
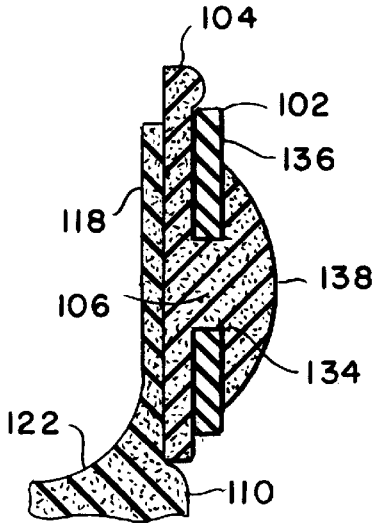
FIG. 11 is a cross-sectional view of the convertible slide of FIG. 1 taken along line 11—11 of FIG. 2 showing the preferred embodiment of attaching the terminal ends of the rear heel strap to the vamp via an integral stud.

It is the side portions 118 extending upward from the midsole 110 that are employed to bond the vamp 104 to the midsole 110 as can be seen in FIGS. 1–4. Reference to FIG. 11 shows the upward extending side portion 118 interfacing with the vamp 104 in the preferred embodiment of the convertible slide 100. The bonding of the side portions 118 to the vamp 104 is accomplished by the use of a suitable adhesive well known in the footwear manufacturing arts. The vamp 104 extends from the forefoot area back to just behind the arch area as can be seen in FIGS. 1–4. Because the vamp 104 terminates in the forefoot area, the forward portion of the convertible slide 100 is open-air. Notwithstanding the open-air design, the top of the vamp 104 can include a plurality of openings 130 which increase the ventilation flow. Further, the plurality of openings 130 can be shaped to enhance the ornamental and cosmetic features of the sandal. The top rear portion of the vamp 104 also includes a smooth contoured surface 132 which is somewhat concave and extends the entire width of the vamp 104 as shown in FIG. 1. Additionally, the contoured lip 108 is molded onto the rear boundary of the contoured surface 132. The contoured surface 132 and the contoured lip 108 will be discussed in more detail in conjunction with the elastic rear heel strap 102 hereinbelow.

Extending outward from and molded to the vamp 104 on each side of the convertible slide 100 is the pair of peg-like studs 106. Each of the studs 106 is preferably comprised of polyvinylchloride (PVC) since they are molded to the vamp 104 and must be compatible therewith. However, the studs 106 can also be fabricated from other materials consistent with the material of the vamp 104 such as rubber, silicon or a PVC-rubber combination. One of the pair of studs 106 is clearly illustrated in FIG. 11 and is shown extending outward in an orthogonal manner from the vamp 104. The length of each of the studs 106 is slightly longer than the width of the elastic rear heel strap 102. Additionally, the circumference of each of the outwardly extending studs 106 is slightly smaller than the diameter of a penetration 134 formed in each of a pair of terminal ends 136 associated with the rear heel strap 102. In the preferred embodiment, each of the studs 106 is passed through the corresponding penetration 134 of one of the terminal ends 136 for rotatively attaching the rear heel strap 102 to the vamp 104.

Each of the peg-like studs 106 that extend outward from the side of the vamp 104 also includes a stop 138 as is clearly shown in FIG. 11. The stop 138 can assume the shape of a button or a mushroom as is clearly shown in FIGS. 1–4. The exterior face of the stop 138 is shaped to resemble the head of a screw having a pair of cross-grooves for accommodating a screwdriver. However, it should be understood that the vamp 104, the pair of studs 106 and the stop 138 are integrally formed of PVC and do not rotate. Thus, the screw head shape of the exterior face of the stop 138 is only cosmetic in nature.

The function of each of the stops 138 is to prevent the terminal ends 136 of the elastic rear heel strap 102 from sliding off of the corresponding outwardly extending stud 106. Thus, each of the stops 138 prevents the rear heel strap 102 from escaping the confines of the corresponding outwardly extending stud 106 whether the heel strap 102 is wrapped about the heel of the foot or is being rotated about the stud 106. Thus, the penetration 134 in the terminal ends 136 of the rear heel strap 102 must be large enough and the length of the outwardly extending studs 106 must be long enough so that the rear heel strap 102 can be freely rotated about the studs 106. The rear heel strap 102 is typically comprised of polyvinylchloride (PVC) and exhibits an elastic characteristic. In the alternative, the rear heel strap 102 can also be comprised of a flexible or stretchable material such as, for example, silicon.

Figure 3:
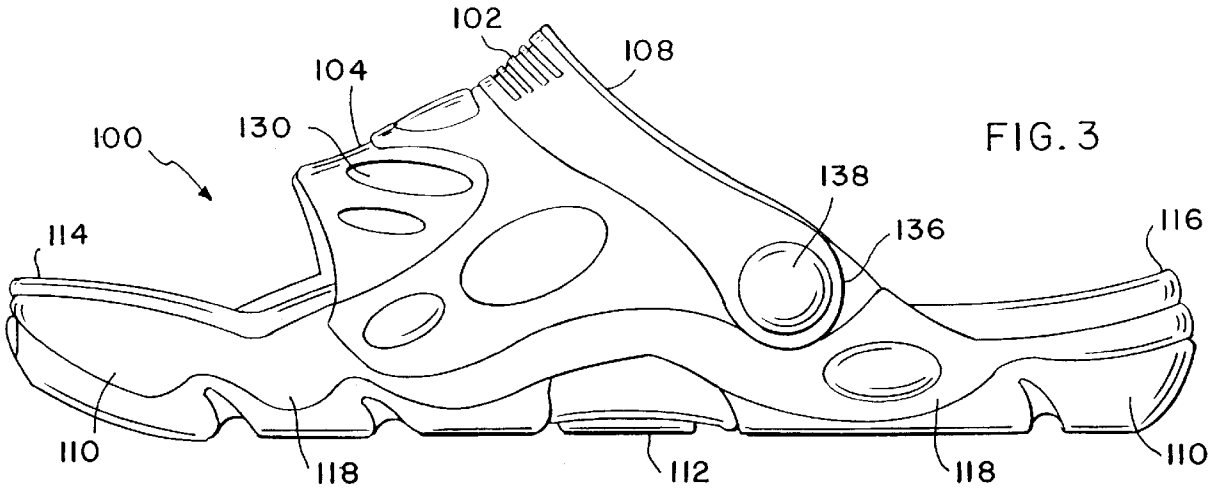
FIG. 3 is a left side elevational view of the convertible slide of FIG. 1 showing the rear heel strap in the rotated raised position and resting forward of the contoured lip on the rear side of the vamp.
Figure 4:
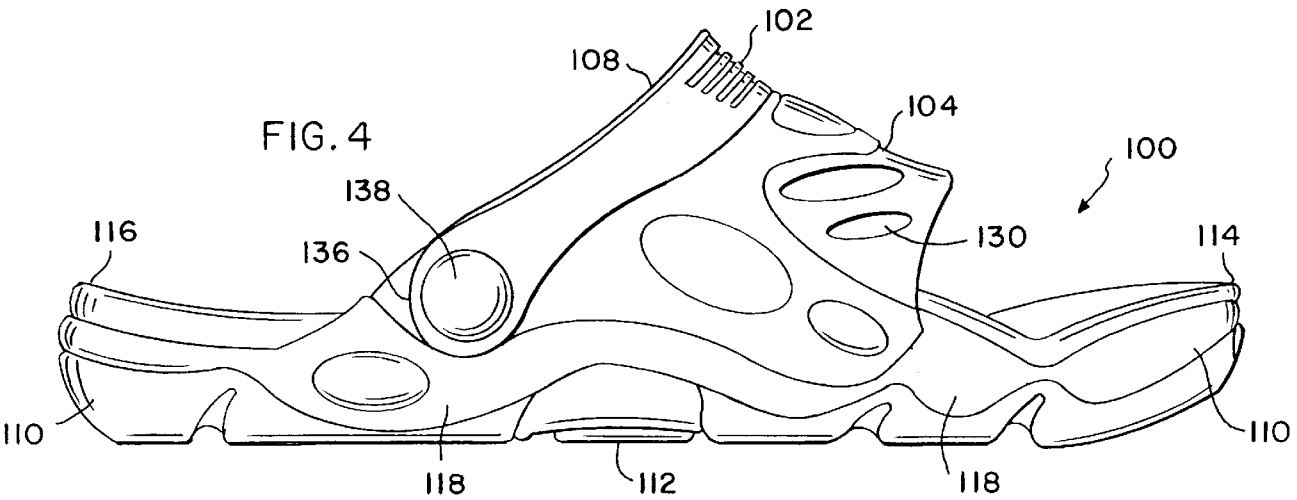
FIG. 4 is a right side elevational view of the convertible slide of FIG. 1 showing the rear heel strap in the rotated raised position and resting forward of the contoured lip on the rear side of the vamp.

When it is desired to wear the convertible slide 100 on the foot, it is first necessary to decide if the footwear is to be employed as a conventional sandal or as a slide (i.e., as a strapless loose fitting sandal). If the convertible slide 100 is to be used as a slide-type sandal (such as when walking on the beach), then the rear heel strap 102 is rotated about the outwardly extending studs 106 until the heel strap 102 is positioned over the smooth contoured surface 132. This position is referred to as the raised position above the vamp 104. The smooth contoured surface 132 shown in FIG. 1 is shaped to receive the rear heel strap 102 as shown in FIGS. 2–4. It is the contoured lip 108 molded on the top rear side of the vamp 104 that serves to hold the rear heel strap 102 on the smooth contoured surface 132 (i.e., in the raised position). Once the rear heel strap 102 is positioned on the smooth contoured surface 132, the foot can slide in between the top surface 122 of the midsole 110 and the vamp 104. The forefoot is then positioned so that the toes of the foot can grasp the toe bar 124 and the arch of the foot is placed over the instep arch support 125. The convertible slide 100 can then be worn as a strapless loose fitting slide-type sandal.

If the convertible slide 100 is to be employed as a conventional sandal then the rear heel strap 102 is moved off of the smooth contoured surface 132 and past the contoured lip 108. The rear heel strap 102 is then rotated from the raised position above the vamp 104 shown in FIG. 2 to a lowered position about the heel of the foot shown in FIG. 1. The foot can then slide in between the top surface 122 of the midsole 110 and the vamp 104. The forefoot is then positioned so that the toes of the foot can grasp the toe bar 124 and the arch of the foot can be placed over the instep arch support 125 as before. Finally, the rear heel strap 102 is securely positioned behind the heel of the foot. The convertible slide 100 can then be worn as a conventional sandal with the rear heel strap 102 positioned about the heel of the foot to provide additional stability as when walking on hard surfaces.

Thus, the elastic rear heel strap 102, which is rotatively connected to the pair of outwardly extending studs 106 as shown in FIG. 11, is rotatable between a first lowered position about the heel of the foot and a second raised position above the vamp 104 which enables the sandal to be used with or without the elastic heel strap 102, respectively. This feature provides the convertible character of the slide-type sandal of the present invention.

Figure 12:
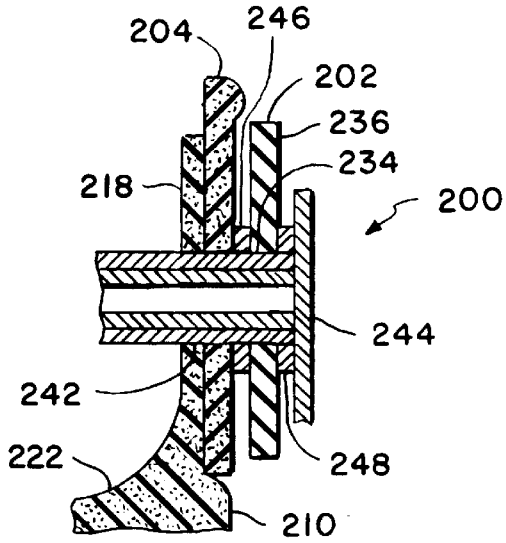
FIG. 12 is a cross-sectional view of a first alternative embodiment of the convertible slide of the present invention showing a second method of attaching the terminal ends of the rear heel strap to the vamp via a rivet.

A first alternative embodiment of the convertible slide of the present invention is shown in FIG. 12 and is referred to by the identification number 200. Each of the components appearing in the alternative embodiment 200 that correspond in structure and function to those components appearing in the preferred embodiment 100 is identified by the corresponding number of the 200 series.

The structural modifications appearing in the first alternative embodiment 200 of the present invention are directed to the method of attaching an elastic rear heel strap 202 to a vamp 204 and a cushioned midsole 210 of the convertible slide 200 as shown in FIG. 12. Each slide-type sandal of the convertible slide 200 includes two attachment points between the vamp 204 and the elastic rear heel strap 202. Thus, the two attachment points require that each side of the slide-type sandal includes the structure shown in FIG. 12. Thus, FIG. 12 shows the structure of only one of the two sides of the sandal. One of a pair of side portions 218 which extends upward from a top surface 222 of the midsole 210 is shown attached to the vamp 204. The attachment between the vamp 204 and the side portion 218 of the midsole 210 is achieved in exactly the same manner as previously described with reference to the convertible slide 100 of the preferred embodiment. The attachment is achieved through bonding by the use of a suitable adhesive well known in the art of footwear manufacturing.

The following description is directed to the method of rotatively connecting each of a pair of terminal ends 236 of the rear heel strap 202 to the vamp 204 and the midsole 210. One of a pair of penetrations 242 is shown formed through the bonded combination of the vamp 204 and side portion 218 of the midsole 210 in FIG. 12. Also, one of a pair of penetrations 234 is shown formed through one of the pair of terminal ends 236 in FIG. 12. It is noted that the penetration 234 formed in the terminal end 236 shown in FIG. 12 is horizontally aligned with the penetration 242 formed through the vamp 204 and the upward extending side portion 218 of the midsole 210. A rivet 244 is inserted through the penetration 234 formed in the terminal end 236 of the rear heel strap 202 and the penetration 242 formed through the vamp 204 and the side portion 218 of the midsole 210. The rivet 244 thus functions to bind the rear heel strap 202, the vamp 204 and the side portion 218 of the midsole 210 together. Additionally, the rivet 244 serves as a pivot point for the rear heel strap 202 to rotate between a first lowered position and a second raised position.

The rivet 244 can be comprised of, for example, plastic, metal, nylon or other suitable material while the elastic rear heel strap 202 and the vamp 204 are each comprised of polyvinylchloride. As with the preferred embodiment 100, the rear heel strap 202 can be comprised of another suitable flexible material such as, for example, silicon. Thus, during rotation of the rear heel strap 202 about the rivet 244, it is common for the friction between the heel strap 202, the vamp 204 and the rivet 244 to interfere with smooth rotation. In order to facilitate smoother rotation of the rear heel strap 202 about the rivet 244, one of a first pair of nylon washer separators 246 is placed on the inside of the rear heel strap 202 and one of a second pair of nylon washer separators 248 is placed on the outside of the rear heel strap 202 as shown in FIG. 12. Thus, the rear heel strap 202 can more freely rotate about the rivet 244 between the first lowered position and the second raised position. The remainder of the operation of the convertible slide 200 is duplicate to that as described for the convertible slide 100 of the preferred embodiment.

Figure 13:
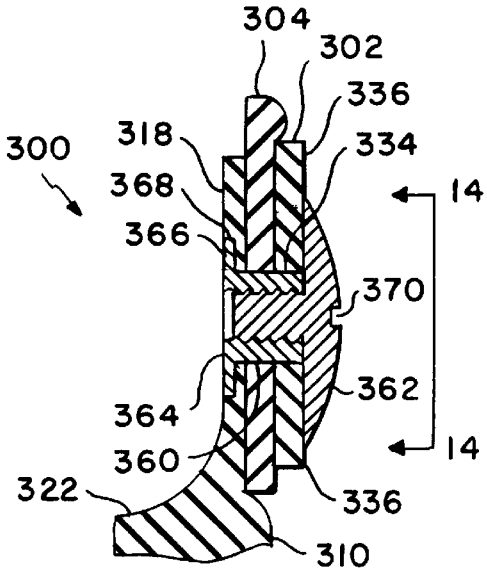
FIG. 13 is a cross-sectional view of a second alternative embodiment of the convertible slide of the present invention showing a third method of attaching the terminal ends of the rear heel strap to the vamp via a screw.

A second alternative embodiment of the convertible slide of the present invention is shown in FIG. 13 and is referred to by the identification number 300. Each of the components appearing in the alternative embodiment 300 that correspond in structure and function to those components appearing in the preferred embodiment 100 is identified by the corresponding number of the 300 series.

The structural modifications appearing in the second alternative embodiment 300 of the present invention are directed to the method of attaching an elastic rear heel strap 302 to a vamp 304 and a cushioned midsole 310 of the convertible slide 300 as shown in FIG. 13. It is noted that the rear heel strap 302 can also be comprised of other suitable flexible materials such as, for example, silicon. Each slide-type sandal of the convertible slide 300 also includes two attachment points between the vamp 304 and the elastic rear heel strap 302. Thus, the two attachment points require that each side of the slide-type sandal includes the structure shown in FIG. 13. Thus, FIG. 13 shows the structure of only one of the two sides of the sandal. One of a pair of side portions 318 which extends upward from a top surface 322 of the midsole 310 is shown attached to the vamp 304. The attachment between the vamp 304 and the side portion 318 of the midsole 310 is achieved in exactly the same manner as previously described with reference to the convertible slide 100 of the preferred embodiment. The attachment is achieved through bonding by the use of a suitable adhesive well known in the art of footwear manufacturing.

The following description is directed to the method of rotatively connecting each of a pair of terminal ends 336 of the rear heel strap 302 to the vamp 304 and the midsole 310.

One of a pair of penetrations 360 is shown formed through the bonded combination of the vamp 304 and side portion 318 of the midsole 310 in FIG. 13. Also, one of a pair of penetrations 334 is shown formed through one of the pair of terminal ends 336 in FIG. 13. It is noted that the penetration 334 formed in the terminal end 336 shown in FIG. 13 is horizontally aligned with the penetration 360 formed through the vamp 304 and the upward extending side portion 318 of the midsole 310. It is noted that more than one pair of penetrations 334 can be formed through the pair of terminal ends 336 for the purpose of adjusting the tension in the rear heel strap 302.

One of a pair of threaded screws 362 is inserted through the penetration 334 formed in the terminal end 336 of the rear heel strap 302 and through the penetration 360 formed through the vamp 304 and the side portion 318 of the midsole 310. Aligned with the threaded screw 362 and also passing through the penetration 360 and the penetration 334 is a threaded receiver known as a T-nut 364. The T-nut 364 includes internal threads that cooperate with the threads of the screw 362 as shown in FIG. 13. The T-nut 364 includes a flat bottom 366 that fits into a recess 368 formed in the interior wall of side portion 318 to avoid rubbing against the foot placed adjacent the side portion 318 of the midsole 310. The threaded screw 362 thus functions to bind together the rear heel strap 302, the vamp 304 and the side portion 318 of the midsole 310. Additionally, the threaded screw 362 serves as a pivot point for the rear heel strap 302 to facilitate rotation between a first lowered position and a second raised position.

Figure 14:
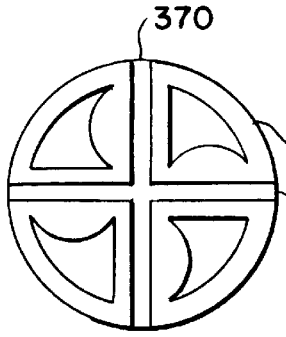
FIG. 14 is an elevational view of the convertible slide of FIG. 1 showing the front of the stud, rivet or screw of FIGS. 11, 12 or 13, respectively, utilized to retain the terminal ends of the rear heel strap to the vamp.

The face of the threaded screw 362 includes a pair of cross-grooves 370 as shown in FIG. 14. The cross-grooves 370 can be manipulated by a screwdriver to remove or insert the threaded screw 362. The threaded screw 362 is removable so that the elastic rear heel strap 302 can be disassembled and removed from the convertible slide 300. Removing the rear heel strap 302 enables the amount of tension therein to be adjusted by changing the penetration 334 in the rear heel strap 302 that the threaded screw 362 is reinserted into.

The threaded screw 362 can be comprised of, for example, plastic, metal, nylon or other suitable material while the elastic rear heel strap 302 and the vamp 304 are each typically comprised of polyvinylchloride. If friction between the heel strap 302, the vamp 304 and the threaded screw 362 interferes with the smooth rotation of the rear heel strap 302 about the threaded screw 362, the method illustrated and described in the convertible slide 200 of the first alternative embodiment can also be employed in the convertible slide 300. Thus, the rear heel strap 302 could more freely rotate about the threaded screw 362 between the first lowered position and the second raised position. The remainder of the operation of the convertible slide 300 is duplicate to that as described for the convertible slide 100 of the preferred embodiment.

The present invention provides novel advantages over other conventional sandal and slide-type sandal footwear known in the art. A main advantage of the convertible slide 100 of the present invention is that the elastic rear heel strap 102 is rotatable about the pair of studs 106 between a first lowered position about the heel of the foot to a second raised position above the vamp 104. This feature enables the sandal to be used with or without the elastic rear heel strap 102, respectively, and thus provides the convertible character of the slide-type sandal. Furthermore, the convertible slide 100 of the present invention is simple to operate since the rear heel strap 102 can be moved between the first lowered position and the second raised position by, for example, simple foot manipulation. Additionally, the convertible slide

100 exhibits a lightweight robust construction that is economical to produce.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. accordingly,

What is claimed is:

1. A convertible slide comprising:

a midsole for supporting a foot;

a vamp securely attached to said midsole for covering said foot, said vamp including a pair of outwardly extending studs for providing a pair of pivot points;

a rear heel strap for securing said convertible slide to said foot, said heel strap being connected to said pair of studs for rotating between a first lowered position about the heel of said foot and a second raised position above said vamp; and an outsole bonded to said midsole for contacting a ground surface, said outsole comprising a plurality of discrete pieces of rugged material bonded within a corresponding plurality of recesses formed in the bottom of said midsole, said bottom of said midsole and said outsole being at the same level.

2. The convertible slide of claim 1 wherein said midsole is comprised of ethylene vinyl acetate.

3. The convertible slide of claim 1 wherein said midsole further includes a toe bar.

4. The convertible slide of claim 1 wherein said midsole further includes an instep arch support.

5. The convertible slide of claim 1 wherein said vamp is comprised of polyvinylchloride.

6. The convertible slide of claim 1 wherein said vamp includes a smooth contoured surface for supporting said rear heel strap in said second raised position.

7. The convertible slide of claim 1 wherein said vamp further includes a contoured lip for retaining said rear heel strap in said second raised position.

8. The convertible slide of claim 1 wherein said vamp includes a plurality of ventilation holes.

9. The convertible slide of claim 1 wherein said rear heel strap is comprised of elastic polyvinylchloride.

10. The convertible slide of claim 1 wherein said rear heel strap is comprised of silicon.

11. The convertible slide of claim 1 wherein said rear heel strap includes a pair of terminal ends wherein each of said terminal ends includes a penetration and wherein each of said pair of outwardly extending studs passes through a corresponding one of said penetrations.

12. The convertible slide of claim 1 wherein each of said outwardly extending studs includes a mechanical stop for retaining said rear heel strap on each of said outwardly extending studs.

13. The convertible slide of claim 1 wherein said outsole is comprised of rubber.

14. The convertible slide of claim 1 further including a cushioned fabric mesh layer bonded to a top surface of said midsole for providing improved comfort and ventilation to said foot.

15. A convertible slide comprising:

a midsole for supporting a foot;

a vamp securely attached to said midsole for covering said foot;

a pair of fasteners, each of said fasteners passing through one of a corresponding pair of penetrations formed through said vamp and said midsole;

a rear heel strap for securing said convertible slide to said foot, said heel strap being connected to said pair of fasteners for rotating between a first lowered position about the heel of said foot and a second raised position above said vamp; and an outsole bonded to said midsole for contacting a ground surface, said outsole comprising a plurality of discrete pieces of rugged material bonded within a corresponding plurality of recesses formed in the bottom of said midsole, said bottom of said midsole and said outsole being at the same level.

16. The convertible slide of claim 15 wherein said pair of fasteners comprises a pair of rivets.

17. The convertible slide of claim 16 wherein each of said pair of rivets further includes at least one washer separator for facilitating the rotation of said rear heel strap.

18. The convertible slide of claim 15 wherein said pair of fasteners includes a pair of threaded screws.

19. The convertible slide of claim 18 wherein each of said pair of threaded screws further includes a T-nut for locking said threaded screws in place.

20. The convertible slide of claim 19 wherein each of said T-nuts is positioned within a recess formed within a side portion of said midsole.

21. The convertible slide of claim 15 further including a cushioned fabric mesh layer bonded to a top surface of said midsole for providing improved comfort and ventilation to said foot.

22. A convertible slide comprising:

a midsole for supporting a foot;

a vamp securely attached to said midsole for covering said foot, said vamp including a pair of outwardly extending studs for providing a pair of pivot points;

a rear heel strap for securing said convertible slide to said foot, said heel strap being connected to said pair of studs for rotating between a first lowered position about the heel of said foot and a second raised position above said vamp;

a contoured lip formed on said vamp for retaining said rear heel strap in said second raised position; and an outsole bonded to said midsole for contacting a ground surface, said outsole comprising a plurality of discrete pieces of rugged material bonded within a corresponding plurality of recesses formed in the bottom of said midsole, said bottom of said midsole and said outsole being at the same level.

* * * * *